US008153940B2

(12) United States Patent
Niemz et al.

(10) Patent No.: US 8,153,940 B2
(45) Date of Patent: Apr. 10, 2012

(54) FLAT HEATER INCLUDING CONDUCTIVE NON-WOVEN CELLULOSE MATERIAL

(75) Inventors: Frank-Günter Niemz, Rudolstadt (DE); Bernd Riedel, Unterwellenborn (DE); Carmen Knobelsdorf, Saalfeld (DE)

(73) Assignee: Thüringisches Institut für Textil-und Kunststoff-Forschung E.V., Rudolstadt (DE)

( * ) Notice: Subject to any disclaimer, the term of this patent is extended or adjusted under 35 U.S.C. 154(b) by 675 days.

(21) Appl. No.: 12/284,694

(22) Filed: Sep. 23, 2008

(65) Prior Publication Data

US 2009/0057296 A1 Mar. 5, 2009

Related U.S. Application Data

(63) Continuation-in-part of application No. PCT/DE2007/000543, filed on Mar. 22, 2007.

(30) Foreign Application Priority Data

Mar. 24, 2006 (DE) ..... 10 2006 014 171

(51) Int. Cl.
*H05B 3/44* (2006.01)
*H05B 1/00* (2006.01)

(52) U.S. Cl. ..... 219/544; 219/211; 219/212; 219/217; 219/528; 219/529; 219/545; 219/549; 219/552; 219/553

(58) Field of Classification Search ..... 219/211, 219/212, 217, 528, 529, 544, 545, 549, 552, 219/553

See application file for complete search history.

(56) References Cited

U.S. PATENT DOCUMENTS 4,534,886 A * 8/1985 Kraus et al. ..... 252/502

FOREIGN PATENT DOCUMENTS

| | | |
|---|---|---|
| DE | 2305105 | 8/1974 |
| DE | 2303389 | 3/1985 |
| DE | 4426966 | 2/1996 |
| DE | 19509153 | 9/1996 |
| DE | 19537726 | 4/1997 |
| DE | 29808842 | 9/1998 |
| DE | 19848860 | 12/1999 |
| DE | 19911519 | 10/2000 |
| WO | 2004081267 | 9/2004 |

* cited by examiner

*Primary Examiner* — Shawntina Fuqua
(74) *Attorney, Agent, or Firm* — Horst M. Kasper

(57) ABSTRACT

The invention relates to a flat heater, which is used for applications in the range of heating voltages of up to 1000 V, produces attainable powers of up to 2 kW/m$^2$ and is characterized by the fact that the electrical resistance required for the heating is formed by an electrically conductive cellulose nonwoven. Metallic contacts which are incorporated ensure the connection of the conductive cellulose nonwoven to a voltage source. Polymer films applied on both sides provide mechanical and electrical protection and prevent the ingress of moisture into the cellulose nonwoven.

11 Claims, 2 Drawing Sheets

FLAT HEATER INCLUDING CONDUCTIVE NON-WOVEN CELLULOSE MATERIAL

REFERENCE TO RELATED APPLICATIONS

This application is a continuation-in-part application to another application filed as a PCT-application with the publication number: WO 2007/110061 and carrying the application number PCT/DE 2007/000543 and carrying a PCT filing date of Mar. 22, 2007.

BACKGROUND OF THE INVENTION INCLUDING PRIOR ART

1. Field of the Invention

The invention relates to a flat heater which is used for an application in the range of heating voltages of up to 1000V.

2. Brief Description of the Background of the Invention Including Prior Art

Present solutions are particularly concerned with electrically conductive materials of various nature being directly woven in or embroidered on ready fabrics. To this end, for example, metallic, metal coated carbon fibers or cellulose fibers are employed, as can be obtained according to DE 4426966 C2 or DE 19537726 C2. Furthermore, in the case of electrically conductive felts, carbon fibers are used according to DE 2303389 C2 and DE 2305105 A1 which are manufactured by carbonizing of, inter alia, cellulose material. Thereby the manufacture is carried out via the steps fiber manufacture, weaving, preparation and finishing the flat heater in a plurality of steps and is very expensive.

Even more recent applications such as DE 19848860 A1, DE 29808842 U and DE 19509153 A1 describe flat heaters made of nonwoven which consist of carbon fibers. In said applications cellulose nonwoven is not mentioned. Furthermore, DE 19911519 A1 discloses a glass fiber nonwoven material which contains portions of carbon fiber. The solutions specified in the mentioned publications start, however, from nonwovens which have to be formed first from filaments and fibers, respectively. The manufacturing of the nonwovens in the course of the fiber or filament production is neither disclosed nor claimed. Manufacturing of spunbonded nonwovens from carbon fibers is not possible.

SUMMARY OF THE INVENTION

1. Object of the Invention

Object of the invention is to manufacture an electrical flat heater from a nonwoven material, said electrical flat heater attains a heating power of about 2 kW/m$^2$ at a heating voltage up to 1000V and exhibits low production expenditures as well as high performance characteristics.

These and other objects and advantages of the present invention will become evident from the description which follows.

2. Brief Description of the Invention

The present invention provides a pillow shaped electrical flat heater having a heating element made of electrically conducting nonwoven filaments.

According to the invention the object is realized by an electrical flat heater including a heating element embodied by a resistance element which is a spunbonded nonwoven consisting of directly spun electrically conductive continuous cellulose filaments, whereby the continuous filaments contain finely distributed electrically conductive additives.

The cellulose fibers of the flat heater can contain electrically conductive carbon black. The cellulose fibers can contain conductive carbon nanotubes as additives. The cellulose fibers can contain nanosilver as additives. The cellulose nonwoven is manufactured by a modified Lyocell process.

The electrically conductive cellulose nonwoven is spun from a cellulose solution in a solvent which solution contains electrically conductive particles apart from the cellulose. Right after the nonwoven has been spun the adherent solvent is washed out, the nonwoven is dried, provided with electrodes across a definite width and subsequently, for insulation, bonded and laminated, respectively, with a foil on both sides.

By virtue of the respective embodiment, characterized by the functional material, the kind and concentration of the same, the width of the nonwoven, the property of the contacts between the conductive fibers, the space between the electrodes, the level of the operation voltage, the output per area can be set at will.

Due to the embodiment the attainable power can be set steplessly up to 2 kW/m$^2$. The flat heater is suited for temperatures up to 100° C. The electrical resistance required for the heating is formed by an electrically conductive cellulose nonwoven which is connected to a voltage source by an electrical contacting.

Thus, the flat heaters can be used within a voltage range of from 12V up to 1000V, whereby heating powers of up to 2000 W/m$^2$ can be attained with maximal continuous temperatures of 100° C. at the surface of the heater.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENTS

Figure 1:
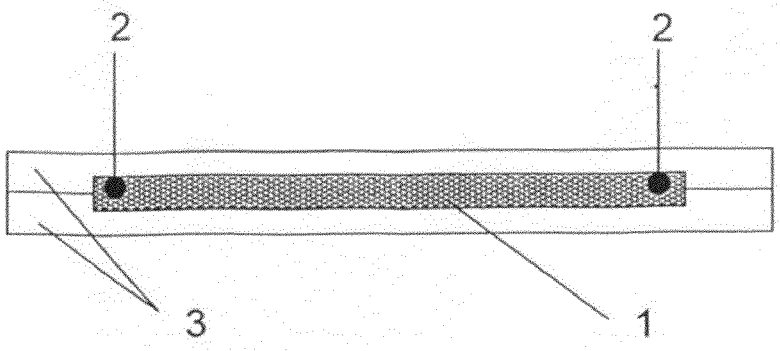
FIG. 1 is a vertical sectional view of a flat heater with conductive non-woven material and with an insulating layer on top and on bottom.

Flat heaters are surface heaters having a flat body, wherein the flat dimensions representing the heating faces are substantially larger than the height of the heating body. The dimensions of the non-woven material can for example be a length of from about 50 cm 200 cm, a width of from about 20 cm to 150 cm, and a layer thickness of from about 0.5 cm to 10 cm, wherein a preferred layer thickness is from about 1 to 3 cm. The flat heater can have a length from about 50 cm to 300 cm, a width of from about 30 cm to 200 cm, and a thickness of from 1 to 10 cm. An example for a flat heater can have a heating face with a length of 160 centimeters and with a width of 120 cm and with a height of the flat heater of 4 cm.

The flat heater contains as the most important component a flat spun non-woven cellulose material 1 comprising electrically conducting cellulose fibers. Metal wires or metal strips are pulled into the non-woven cellulose material or are applied strip shaped on the surface of the non-woven material by distribution of a metallic lacquer such as silver lacquer for obtaining electrical contact strips 2. At least two parallel to each other running and in each case longitudinally or cross wise along the width applied contact strips are present. The distance of the contact strips 2 relative to each other and depending on the desired heating power and the area dimensions of the heating surface is selected and amounts to for example 70 cm to 100 cm. One end of the contact strips 2 is connected to contact clamps 4, wherein the clamps are led out of the non-woven cellulose material and are connected through electrical connection cables 5 to a direct current source 6, wherein the voltage of the direct current source 6 amounts to up to about 1000 volts and is preferably from about 12 to 230 volts.

The electrically conducting non-woven cellulose material is covered at its upper side and at its lower side full face in each case with a polymer foil as an electrical insulating layer 3, wherein the projecting edge regions of the polymer foil are such glued or laminated to each other, that the insulating layer protects the non-woven material from about penetrating humidity and mechanical impacts and furnishes an additional mechanical strength.

Upon application of a DC current to the contact strip 2 an electrical current flows to the electrically conducting cellulose fibers and warms the non-woven cellulose material 1 by way of resistance heating.

The non-woven cellulose material 1 is the spunbonded non-woven material. Spunbonded non-woven materials are a particular kind of non-woven materials comprising fibers which have been mechanically, thermally, and chemically solidified and contacted. The fiber and non-woven material formation are performed in a process step for spunbonded non-woven materials that is the laying of the non-woven material and the solidification of the non-woven material during the spinning process. Generally non-woven materials are not woven textile flat formations or fabrics.

A non-woven material is always defined by its weight per unit area in analogy to the definition of the density. The weight per unit area is driven in the individual embodiment example.

Such nonwovens will be obtained by a modified version of a Lyocell process, as is described, for example, in DE 10145639. To this end cellulose will be dissolved along with a component raising the conductivity such as, for example, conductive carbon black or carbon nanotubes or metal particles in the nano range in an organic solvent such as, for example, aqueous n-methylmorpholin-n-oxide and subsequently spun to a spunbonded nonwoven. The manufacture of the spunbonded nonwoven can be carried out by the conventional spinning process which is characterized by fibers which are spun through an air gap into an aqueous coagulating bath, by the blow spinning process, the centrifugal spinning or the nanoval method which are described, for example, in DE 10145639 and DE 19929709. Thus, by selecting different spinning parameters, nonwovens can be produced, the weight per unit area of which can lie between 10 and 500 $g/m^2$.

Electrically conducting cellulose fibers are employed for the flat heater. The normally electrically insulating cellulose fibers contain in the present flat heater a substantial component of finely distributed electrically conducting materials such as conductive carbon black, carbon nanotubes or also metallic particles with a particle size in the nano region. In modification of the process solution described in the German printed Patent publication DE-OS 10145639 and employed there by the applicant for the production of ceramic materials of an aqueous spinning solution of cellulose and N-methylmorpholine-N-oxide (NMMO) as a solvent for cellulose, wherein the materials improving the electrical conductivity are added to the spinning solution and are spun together with the dissolved fiber material according to the Lyocell method directly to a non-woven cellulose material.

Conventional spunbonded non-woven materials are spun from a melt of the material to be spun. Presently the non-woven spun cellulose material spun according to a modified variation of the Lyocell method, wherein cellulose material is spun to endless filaments from the solution containing the material for increasing the electrical conductivity. An endless filament designates an endless thread in contra-distinction to a staple fiber.

The kind and the amount of the finally distributed electrically conducting materials in the cellulose is variable and determines the conductivity and the electrical resistance of the non-woven material and therewith also the heating power of the flat heater.

The nonwovens obtained in such a manner will be provided with at least two one-directional electric contact stripes and on both sides with electrically insulating foils either right after spinning, aftertreatment and drying or time-delayed. The space between the contact stripes will vary depending on the desired heating power and on the intended voltage. The contact stripes are formed either by thread-in metal wires, metal fleece stripes, metal foils or by an applied metallic lacquer such as, for example, conducting silver lacquer. The bonded or laminated polymer foil which is applied to both sides of the nonwoven and which projects over the rims of the nonwoven provides a mechanical and electrical protection and prevents the ingress of moisture into the cellulose non-woven. The same properties are achieved when the nonwoven is completely embedded into electrically insulating and water proof materials 3.

Figure 2:
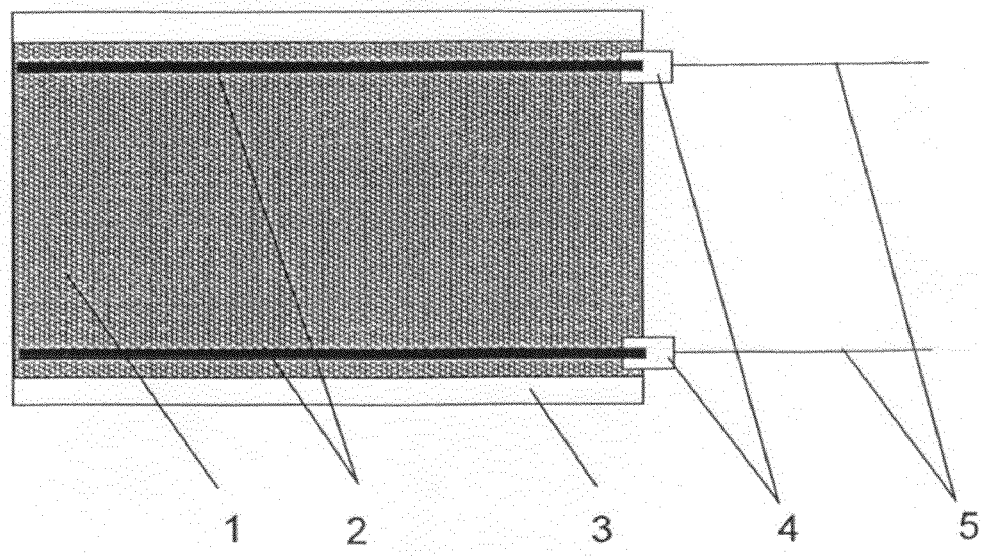
FIG. 2 is a horizontal planar sectional view of the flat heater of FIG. 1.
Figure 3:
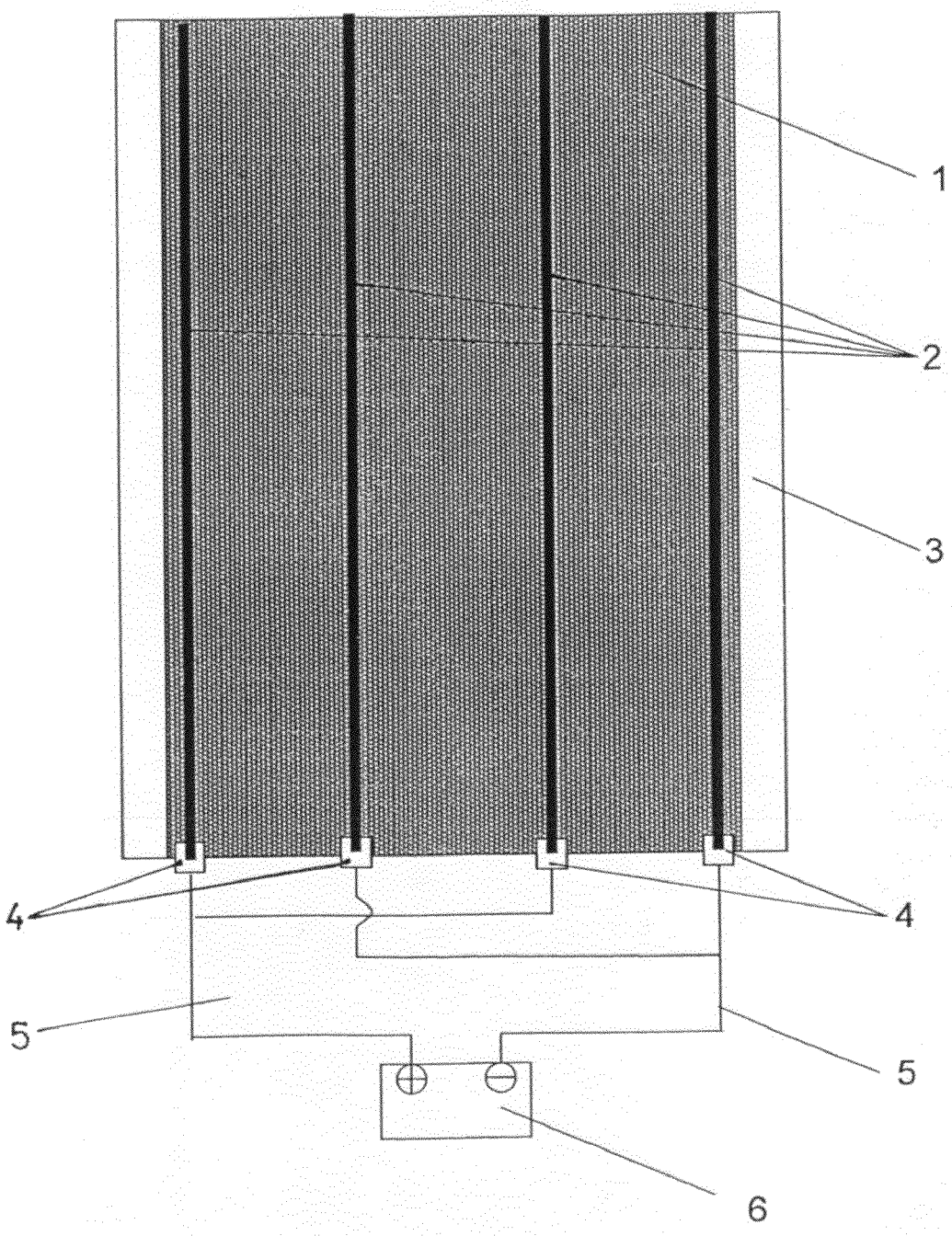
FIG. 3 is a horizontal planar sectional view of another flat heater having four contact lines connected to a power source.

The resulting compound of conductive spunbonded non-woven insulated on both sides and provided with contacts is schematically shown in FIG. 1. The final finishing is carried out by the steps cutting to the desired length, applying suitable electrical contactings 4 to the contact stripes 2 and electrical insulation 3 of the same. The setup of a flat heater obtained in such a manner is schematically shown in FIG. 2. FIG. 3 shows a heater with four or six contact stripes 2 which is connected to a direct current source 6. The contact strips 2 are electrically connected to contact terminals 4 and in turn the contact terminals 4 are connected with a connection cable 5 to a direct voltage source 6.

Surprisingly, the cellulose spunbonded nonwoven composites obtained in this manner supply an electric resistance which is almost independent of the compression load and that in a range which is relevant for generating heat energy. By means of such nonwovens 1 it is possible to obtain almost steplessly the desired heat output at a predetermined voltage. Furthermore this kind of flat heaters is characterized by an absolutely constant heat development across the heated area. Thus, a temperature gradient within the surface or hot spots at higher heating powers are excluded. The favorable performance characteristics of the inventional heating nonwoven can be explained inter alia thereby that conductivity fluctuations are lower with the cellulose fibers formed from endless filaments the fluctuations being additionally reduced when the single fibers are connected with one another at crossing points.

Furthermore, the manufacturing expenditures for the production of the electrical flat heaters are advantageously reduced by combining the manufacturing of the fibers with the manufacture of the spunbonded nonwoven, since certain production steps can be omitted partially or even entirely.

EXAMPLES

Embodiment (Example) 1

A spunbonded nonwoven 1 obtained by a blow spinning process and characterized by a surface weight of 60 g/m$^2$ and containing, in addition to cellulose, 50%-weight of a conductive carbon black of the type Printex L, is provided with contact stripes 2 of conductive silver lacquer which stripes 2 are spaced apart by 6 cm, and is laminated at a temperature of 125° C. and at a roller press gap of 0.3 mm between two polyester foils having a thickness of 190 μm. After applying a voltage of 12 V the obtained flat heater supplies a power of 90 W/m$^2$.

Embodiment 2

A spunbonded nonwoven 1 which is produced as in example 1, however, having the contacting provided at a space of 70 cm. After applying a voltage of 230 V the obtained flat heater supplies a power of 440 W/m$^2$.

Embodiment 3

A spunbonded nonwoven 1 which is produced as in example 2, however, having the contacting provided by three nickel-plated copper filaments of a diameter of 0.2 mm per each contact stripe. After applying a voltage of 230 V the obtained flat heater supplies a power of 440 W/m$^2$.

Embodiment 4

A spunbonded nonwoven 1 produced by a conventional spinning procedure and characterized by a surface weight of 150 g/m$^2$, containing besides the cellulose 50% of conductive carbon black of the type Printex L, is provided with conductive silver lacquer contact stripes 2 spaced apart by 12 cm and laminated between two three-layered polyester foils of a thickness of 20 μm per layer and at a temperature of 125° C. and at a roller press gap of 0.1 mm. After applying a voltage of 42 V the obtained flat heater supplies a power of 1200 W/m$^2$.

Embodiment 5

A spunbonded nonwoven 1 which is produced as in example 2, however, having the contacting provided at a space of 100 cm. After applying a voltage of 230 V the obtained flat heater supplies a power of 215 W/m$^2$.

Embodiment 6

A spunbonded nonwoven 1 produced as in example 2, the weight per unit area being, however, about 150 g/m$^2$. After applying a voltage of 230 V the obtained flat heater supplies a power of 1100 W/m$^2$.

Embodiment 7

A spunbonded nonwoven 1 produced as in example 2, the weight per unit area being, however, about 40 g/m$^2$. After applying a voltage of 230 V the obtained flat heater supplies a power of 440 W/m$^2$.

LIST OF REFERENCE NUMERALS

1 electrically conductive cellulose nonwoven
2 electric contact stripes
3 electric insulation layer
4 contact terminal
5 connection cable
6 direct voltage source

The invention claimed is:

1. Flat heater with a heating element formed by a resistance heating, characterized in that the heating element is a direct spun spunbonded nonwoven manufactured by a modified Lyocell process consisting of electrically conductive cellulose fibers, whereby the spun cellulose fibers are endless filaments containing electrically conductive finely distributed additives embedded therein.

2. Flat heater as claimed in claim 1, characterized in that the cellulose fibers contain conductive carbon black.

3. Flat heater as claimed in claim 1, characterized in that the cellulose fibers contain conductive carbon nanotubes as additives.

4. Flat heater as claimed in claim 1, characterized in that the cellulose fibers contain nanosilver as additives.

5. A flat heater comprising a heating element for resistance heating, wherein the heating element is a direct spun spunbonded non-woven material made of electrically conductive cellulose fibers, wherein the spun cellulose fibers are endless filaments containing finely distributed and an electrically conductive additive embedded in the electrically conductive cellulose fibers.

6. The flat heater as claimed in claim 5, wherein the electrically conductive cellulose fibers contain embedded conductive carbon black.

7. The flat heater as claimed in claim 5, wherein the electrically conductive additive is furnished by conductive carbon nanotubes.

8. The flat heater as claimed in claim 5, wherein the electrically conductive additive is furnished by nanosilver.

9. The flat heater as claimed in claim 5, wherein the cellulose non-woven material is prepared by a modified Lyocell process.

10. The flat heater as claimed in claim 5, wherein the cellulose non-woven material is prepared by dissolving cellulose along with a component capable of raising the conductivity in an organic solvent;

subsequently spinning to a spunbonded nonwoven;

preparing the spunbonded nonwoven by a spinning process.

11. The flat heater as claimed in claim 5, wherein the cellulose non-woven material is prepared by dissolving cellulose along with a component capable of raising the conductivity selected from the group consisting of conductive carbon black, carbon nanotubes and metal particles in the nano range in an organic solvent of aqueous n-methylmorpholin-n-oxide;

subsequently spinning to a spunbonded nonwoven;

preparing of the spunbonded nonwoven carried out by a process step of a group of process steps consisting of a spinning process which is characterized by fibers which are spun through an air gap into an aqueous coagulating bath, by a blow spinning process, by a centrifugal spinning and by a nanoval method.

* * * * *